US005347783A

United States Patent [19]

Frecska et al.

[11] Patent Number: 5,347,783

[45] Date of Patent: Sep. 20, 1994

[54] PRENOTCHED FIRE-RATED RUNNER

[75] Inventors: Sandor A. Frecska; Ernest B. Nute, Jr., both of Lancaster, Pa.; Gale E. Sauer, Sinclairville, N.Y.

[73] Assignee: Armstrong World Industries, Inc., Lancaster, Pa.

[21] Appl. No.: 27,726

[22] Filed: Mar. 4, 1993

[51] Int. Cl.[5] ..... E04B 9/00

[52] U.S. Cl. ..... 52/506.07; 52/573.1; 52/DIG. 5

[58] Field of Search ..... 52/484, 1, 573, DIG. 5, 52/506.07

[56] References Cited

U.S. PATENT DOCUMENTS

| | | | |
|---|---|---|---|
| Re. 33,501 | 12/1990 | Platt et al. | 52/573 X |
| 3,175,655 | 3/1965 | Brown et al. | 52/573 |
| 3,189,138 | 6/1965 | Znamirowski | 52/484 X |
| 3,189,139 | 6/1965 | Znamirowski | 52/573 |
| 3,388,519 | 6/1968 | Downing, Jr. | 52/573 |
| 3,390,503 | 7/1968 | Emerick, Jr. et al. | 52/484 X |
| 3,397,501 | 8/1968 | Jahn | 52/484 X |
| 3,496,690 | 2/1970 | Jahn | 52/573 |
| 3,589,089 | 6/1971 | Kedel | 52/573 X |
| 3,807,111 | 4/1974 | Brady | 52/484 X |
| 4,016,701 | 4/1977 | Beynon | 52/573 X |
| 4,128,978 | 12/1978 | Beynon | 52/573 X |
| 4,598,514 | 7/1986 | Shirey | 52/DIG. 5 |
| 4,785,595 | 11/1988 | Dunn | 52/484 X |
| 4,893,444 | 1/1990 | Ollinger et al. | 52/484 X |

FOREIGN PATENT DOCUMENTS

| | | | |
|---|---|---|---|
| 1447055 | 8/1976 | United Kingdom | 52/573 |

*Primary Examiner*—Carl D. Friedman
*Assistant Examiner*—Kevin D. Wilkeus

[57] ABSTRACT

The grid member is formed of sheet metal and has an inverted T-shape with a bulb at the top, a double thickness central web and oppositely disposed flanges at the bottom. To achieve controlled expansion, two parallel lances are cut along opposite sides of the bulb near the top of the bulb. No metal is removed at this area of maximum bending stress. Further, staggered cutouts are placed in the two thicknesses which make up the web. By staggering the cutout areas of adjacent web layers, the overall web strength is maintained. These web cutouts and the lance at the top of the bulb cooperate upon thermal expansion, causing the bottom flanges to buckle down, and the web and sides of the bulb to separate laterally and fold, and the top of the bulb to buckle up. The folded web configuration directed by the staggered cutout pattern will maintain longitudinal rigidity.

3 Claims, 2 Drawing Sheets

PRENOTCHED FIRE-RATED RUNNER

BACKGROUND OF THE INVENTION

1. Field of the Invention

This invention relates generally to a fire-resistant, ceiling board supporting grid system, and more particularly, to runner members capable of absorbing compressive elongation without substantial buckling as might occur during abnormal elevated temperatures, thereby preserving the integrity of the ceiling as a fire barrier under such conditions.

One of the critical problems encountered in these supporting grid structures is to maintain integrity under abnormally elevated temperatures, such as during a fire. Under these high temperature conditions, metallic grid members, which generally are fixed at their end points, expand and buckle whereby the supported ceiling panels are displaced and drop through the openings formed by the buckled grid members. As a result, the effectiveness of the suspended ceiling as a fire barrier is destroyed and the support structure is exposed to fire.

Prior art has considered structures for absorbing thermally induced compression in a supporting grid member. Most of the early designs used multiple expansion joints in a main runner. A relatively close placement of expansion joints will perform best in fire. This is because, when subjected to fire, the intersecting cross tees will remain close to their original spacings and thereby continue to support the panels. The early systems, however, were severely weakened at their expansion relief locations and could not be installed efficiently without excessive handling damage. Further, they were weak in cross bending and could not maintain beam alignment when exposed to fire.

To resolve this problem, some of the commercial systems reverted to main beams with only one relief point located near the end of the runner (reference U.S. Pat. No. 3,388,519). This however, reduced the handling problem at the expense of optimum fire performance.

Over the years there have been step-by-step improvements in systems that use multiple relief points in each main runner. However, the above problems, to a lesser degree, remain valid even in the improved systems. U.S. Pat. Nos. 3,778,947, 3,965,631 and 4,606,166 show products that handle marginally well when the web is kept vertical. The crushed bulb of these designs, however, limits handleability. This is especially true when a beam is handled on its side. U.S. Pat. Nos. 4,016,701 and 4,128,978 show products with metal removed from the top of the bead. This is the area of maximum bending stress, and the removal of metal here will significantly reduce load carrying capacity.

SUMMARY OF THE INVENTION

Accordingly, one object of the present invention is to provide an improved fire-rated grid member which absorbs longitudinal compression resulting from extreme heat and provides controlled deformation at predetermined areas so as to preserve the integrity of a supported fire-resistive ceiling.

Another object of this invention is to provide a fire-rated grid member with multiple relief points, which is less fragile to damage in handling.

Still another object of the present invention is to provide a grid member with stronger expansion relief areas, which can better withstand ceiling loads in a normal situation and at extreme temperatures.

A further object of the present invention is to provide an improved fire-rated grid member which may be manufactured with less complex tooling.

In summary, the present invention provides a fire-rated grid member with multiple areas which provide expansion relief when exposed to high temperatures. The grid member is formed from a strip of metal into the shape of an inverted T-shape with a bulb at the top, a double thickness central web and oppositely disposed flanges at the bottom.

The areas of expansion are configured with a lance on either side of the bulb. Metal is not removed from the bulb, nor is the bulb crushed or formed in a manner which could weaken the section to lateral bending. A knock-out pattern is placed in the two web thicknesses. These web cutting patterns occur staggered on the adjacent web thicknesses to maintain greater strength. When the grid member is put into compression, as would occur in high temperatures, the expansion relief area will buckle in a controlled manner. The flange will fold down, the bulb top will move upward, the bulb sides and webs directed by the cut and lance patterns will slip laterally past each other. A relatively rigid section will remain after the expansion relief has occurred.

DESCRIPTION OF THE PREFERRED EMBODIMENTS

Figure 1:
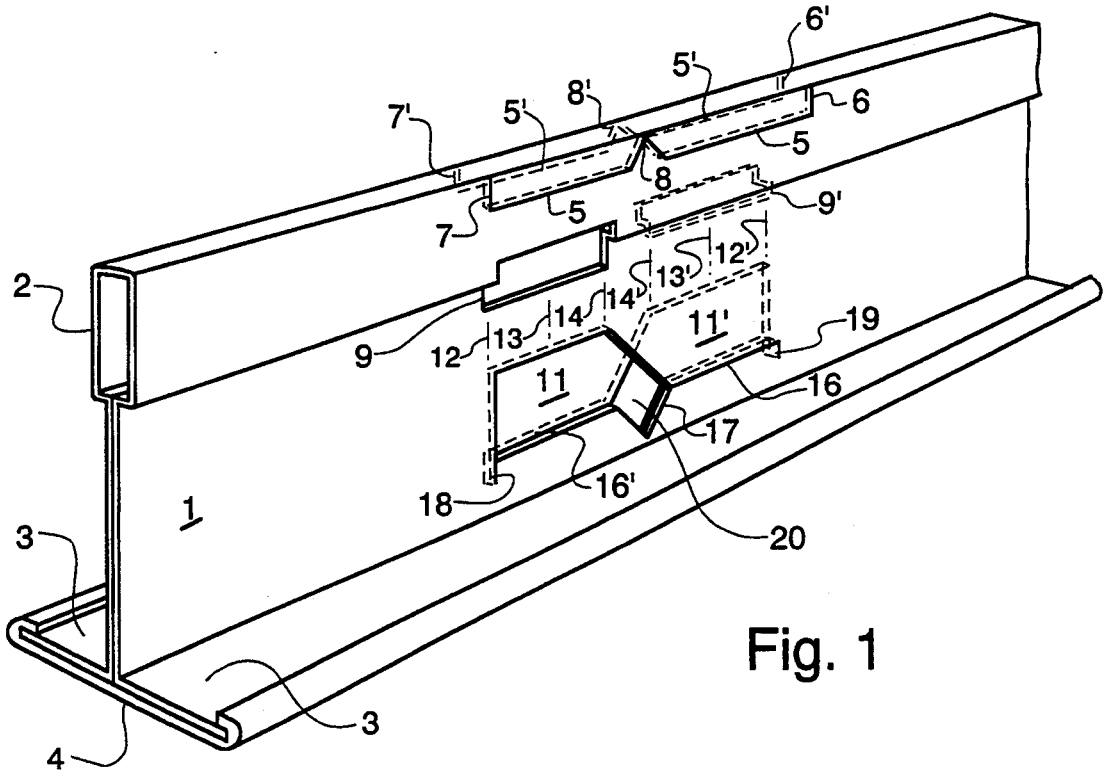
FIG. 1 is a perspective view of the expansion relief area within the grid member. Hidden lines are used to show the web cutouts hidden from view.
Figure 3:
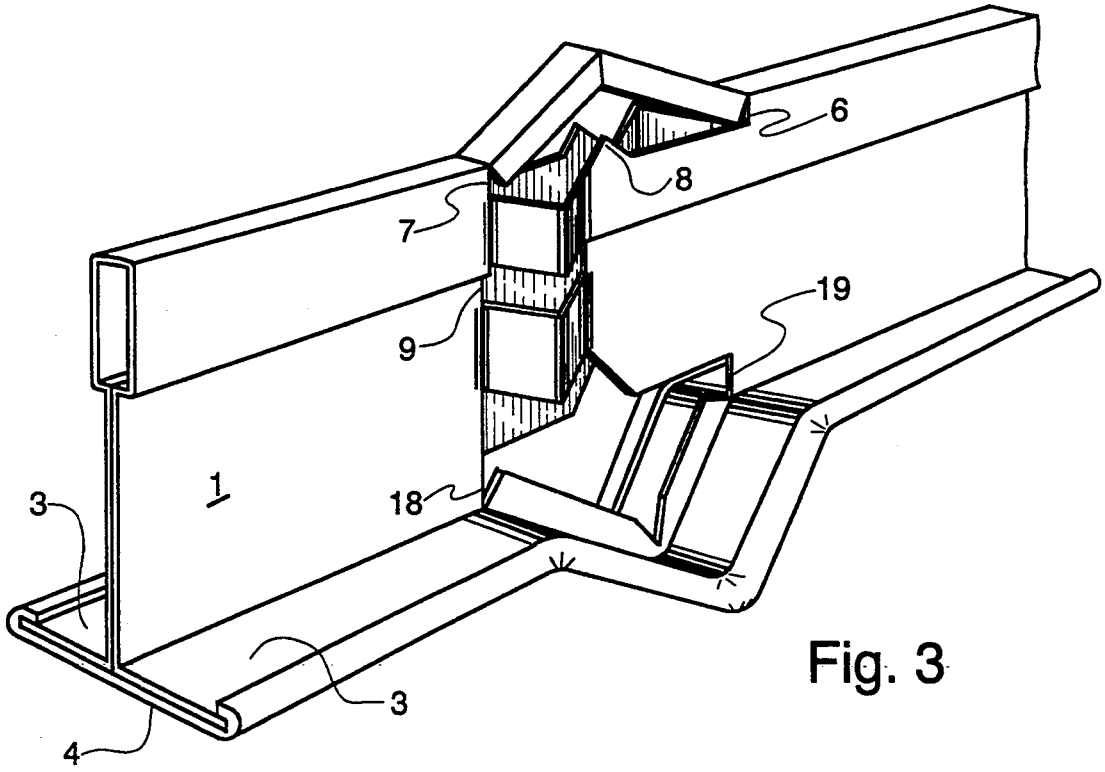
FIG. 3 is a perspective of the grid member which has undergone thermal expansion.

Referring to FIGS. 1 and 3, there is shown a fire-rated runner having an inverted T-construction which includes a central web 1, having a bulb 2 at the top and a pair of oppositely disposed flanges 3 at the bottom for supporting ceiling panels. The fire-rated runner is of the double web type in which a strip of sheet metal is bent intermediate its longitudinal edges to form the bulb 2 with the portion of the strip at opposite sides of the bulb being brought into parallel relation to form the web 1 and the edge portions of the strip being bent at right angles thereto to form the oppositely disposed flanges 3. A separate decorative cap 4 covers the flanges and is formed by a strip of material having its longitudinal edges folded around the adjacent edges of the associated flanges 3. The runner just described is generally of standard construction as utilized in the trade.

Figure 2:
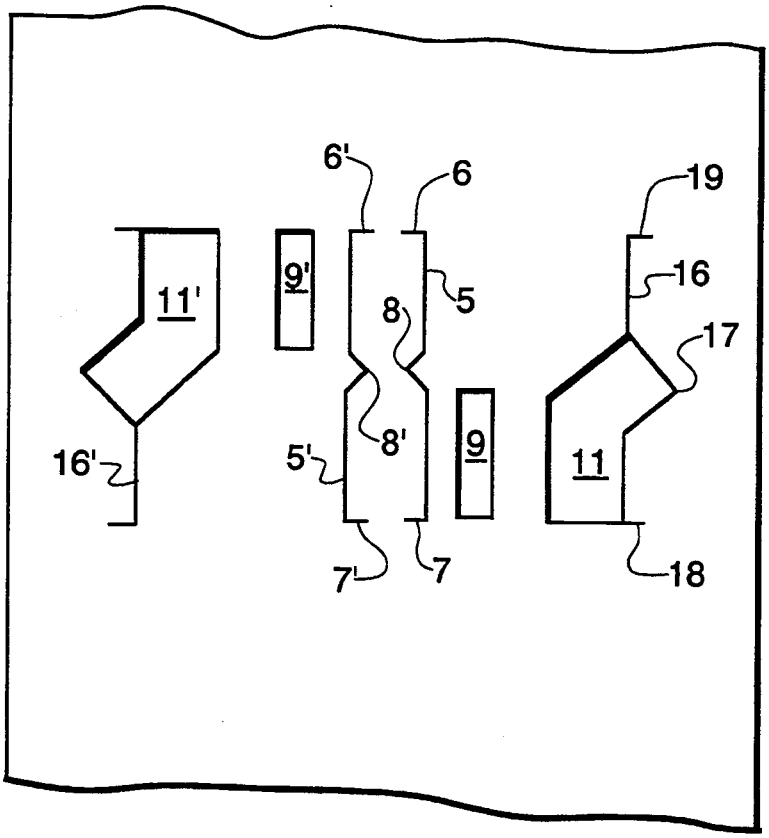
FIG. 2 is a segment of the metal strip before it is formed into a T-section. The segment shows the cutout pattern which becomes the expansion relief area of the grid member.

The expansion areas of the fire-rated beam are created by a cutout and lance pattern as shown in FIG. 2. To eliminate distortions to the bulb, and to simplify the process and tooling, the cutout and lance pattern is punched into the metal strip before it is formed into an inverted T. FIG. 2 shows this pattern applied to the strip of metal before it is formed. FIG. 3 shows the expansion area of the fire-rated runner after it has functioned to relieve thermal expansion.

The many features of the cutout and lance patterns, as shown in FIGS. 1 and 2, cooperate to achieve the controlled expansion shown in FIG. 3.

At both opposite sides of the bulb is an elongated lance 5,5'. With an extreme compressive force applied longitudinal to the bulb, the top of the bulb, adjacent the two lances, will buckle up. Note that points 6, 7 and 8 occur along lance 5 very close to the top plane of the bulb. Likewise, points 6', 7' and 8' occur along lance 5' very close to the top plane of the bulb and are directly opposite points 6, 7 and 8. When compressive buckling occurs, the buckling at the top of the bulb is controlled with predictable bending at lines 6,6', 7,7' and 8,8'. Now, note cutout 9 which removes formed metal from one side of the web near the bottom of the bulb and at the bottom of the bulb. Cutout 9 and lance 5 will permit the adjacent metal in the side of the bulb to buckle laterally. Cutout 9' is opposite and staggered from cutout 9. Cutout 9' and lance 5' will permit the adjacent metal in the side of the bulb to buckle laterally. The cutouts 9 and 9' may be rectangular, oval, three round holes side-by-side or other shapes. The cutouts can extend into the side wall of the bulb.

In order for the above to occur, there must be equal longitudinal expansion relief in the web and in the bottom flange. Cutout 11 and 11' account for the controlled expansion relief in the two web thicknesses. Additional vertical hinge lines develop at 12, 13 and 14 and 12', 13' and 14'. The web metal adjacent these hinge lines will fold out laterally in control buckling.

An optional feature to this invention would be to crease the above noted hinge lines a small amount in the direction they are to function.

As the bulb and the web relieve expansion as noted above, the flange 3 will buckle downward. The lower end of cutouts 11 and 11' and lance 16 and 16' free the flange from the web at the expansion relief area. The V-shaped notch in the web 17 which is in close proximity to the flange will permit the flanges to buckle. This controlled flange buckling is also facilitated by cuts 18 and 19 which are also cut close the flange. To direct the flange to buckle down and not up, notch 17 must be closer to the flange than cuts 18 and 19. Notch 17 and cuts 18 and 19 are collectively called cuts.

FIG. 3 shows the relief area of the main runner collapsed in the above-described controlled manner.

Features unique to this invention make this expansion relief stronger than the earlier designs. The elongated lances along the upper sides of the bulb is one of those features. When an inverted T-beam is loaded, the metal at the top of the bulb must carry a longitudinal stress which is greater there than any other area of the section. A removal of material at the top of the bulb or a lance normal to the beam direction would remove stress resistance in this critical area. In such a case, the section would have a reduced load carrying capacity.

Further, the bulb is not weakened by forming or crushing intended to direct expansion relief as in earlier designs.

A totally unique feature to this invention is the staggered cut and lance pattern on the two adjacent web pieces. There is only a small through cut area 20 where both web thicknesses are through cut in the same area. This are 20 is well less than 50% of the cutout area 11. This enhances twist resistance and handleability. Where one side of the web is weakened for expansion relief, the other adjacent side of the web remains intact to resist distortion. This feature also permits greater load carrying capability to be maintained after the thermal expansion has occurred.

What is claimed is:

1. A fire expansion section for a ceiling runner wherein:

(a) the ceiling runner with longitudinal ends has a vertical web member having at its upper end a bulb-shaped element with two spaced side walls, a bottom wall and a top wall, and at its lower end oppositely positioned flanges on either side of the web to support ceiling boards, said web member consisting of two side-by-side pieces of metal, each piece connected at the bottom of the web to a flange and connected at the top of the web to the bottom wall of the bulb; and (b) said fire expansion section being located between the longitudinal ends of the ceiling runner comprising:

(1) a lance cut in each side wall of the bulb-shaped element without the removal of metal;

(2) a web cutout in one piece of the metal of the web at the top of the web adjacent the bulb bottom wall and into the bulb bottom wall of the runners bulb near and below one end of the lance in one side wall and a corresponding cutout similarly located in the other piece of metal of the web and bulb bottom wall near and below the opposite end of the other lance in the other side wall;

(3) said bulb bottom walls being unconnected at their edges adjacent the web;

(4) three evenly spaced apart cuts in the web near the flanges, the center cut at its lower end being V-shaped with the point of the V-shape positioned near the flange to form a notch, the center cut being cut through both pieces of metal forming the web, a cut on one side of the center notch being cut through only one piece of metal forming the web with the cut located below the web cutout in the same piece of metal, a cut on the other side of the center notch being cut through the other piece of metal forming the web and positioned in the same manner as 34 the cut on the said one side; and (5) the upper ends of the three cuts being connected by a severance of the metal above the cuts.

2. A fire expansion section for a ceiling runner as set forth in claim 1 wherein:

(a) the severance of the metal above the three cuts is a removal of metal above the said side cut in the metal and a slit cut in the metal adjacent the said other side cut.

3. A fire expansion section for a ceiling runner as set forth in claim 1 wherein:

(a) the cutout in one piece of the metal of the web at the top of the web extends into the bottom wall and side wall of the bulb.

* * * * *